US007371053B2

(12) United States Patent
Schmidt

(10) Patent No.: US 7,371,053 B2
(45) Date of Patent: May 13, 2008

(54) TWO-STAGE HYDRAULIC PUMP

(75) Inventor: Michael R. Schmidt, Carmel, IN (US)

(73) Assignee: General Motors Corporation, Detroit, MI (US)

( * ) Notice: Subject to any disclaimer, the term of this patent is extended or adjusted under 35 U.S.C. 154(b) by 683 days.

(21) Appl. No.: 10/901,721

(22) Filed: Jul. 29, 2004

(65) Prior Publication Data

US 2006/0024179 A1 Feb. 2, 2006

(51) Int. Cl.
*F04B 23/04* (2006.01)
*F04B 23/12* (2006.01)

(52) U.S. Cl. ..... 417/62; 417/206; 417/213; 418/225

(58) Field of Classification Search ..... 417/62, 417/205, 206, 213; 418/225
See application file for complete search history.

(56) References Cited

U.S. PATENT DOCUMENTS 3,081,706 A * 3/1963 Drutchas et al. ..... 417/204
3,953,153 A * 4/1976 Huber et al. ..... 417/204
4,102,606 A * 7/1978 Huber et al. ..... 417/204
4,222,712 A * 9/1980 Huber et al. ..... 417/204
4,578,948 A * 4/1986 Hutson et al. ..... 60/487
6,857,862 B2 * 2/2005 Johnson et al. ..... 418/30

* cited by examiner

*Primary Examiner*—Charles G Freay

(57) ABSTRACT

A two-stage hydraulic pump includes a rotor, a ring, and a plurality of rollers disposed in slots formed on the rotor. The pump has two inlet ports and two outlet ports, which are disposed inwardly and outwardly, respectively, of the rollers. A valve mechanism is incorporated which provides for flow directional control of the output flow of the pump between one portion of the discharge ports and a portion of the inlet ports when a low output flow is desired and blocking that interconnection while connecting the inner portion of the suction inlet side with a reservoir.

8 Claims, 2 Drawing Sheets

TWO-STAGE HYDRAULIC PUMP

TECHNICAL FIELD

This invention relates to hydraulic pumps and, more particularly, to hydraulic pumps that are changed in capacity from one operating condition to another.

BACKGROUND OF THE INVENTION

Two-stage hydraulic systems generally employ two hydraulic pumps. One pump is operated for low flow conditions and both pumps are operated for high flow conditions. Other two-stage pumps might control a portion of the output flow to a reservoir and a portion of the output flow to a hydraulic system during low flow conditions and both output portions to the hydraulic system during high flow conditions.

SUMMARY OF THE INVENTION

It is an object of the present invention to provide an improved two-stage hydraulic pump.

In one aspect of the present invention, the hydraulic pump has a plurality of rollers operable in slots on a rotor to provide the movement of hydraulic fluid from an input low-pressure area to an output high-pressure area.

In another aspect of the present invention, the pumps cooperate with the rotor to provide two pumping chambers and two inlet chambers.

In yet another aspect of the present invention, a control valve is incorporated to direct fluid flow from the output chamber to the desired hydraulic location.

In still another aspect of the present invention, the control valve is operable to direct a portion of the output flow to one of the input chambers thereby reducing the amount of flow going to a hydraulic system.

DESCRIPTION OF AN EXEMPLARY EMBODIMENT

Figure 1:
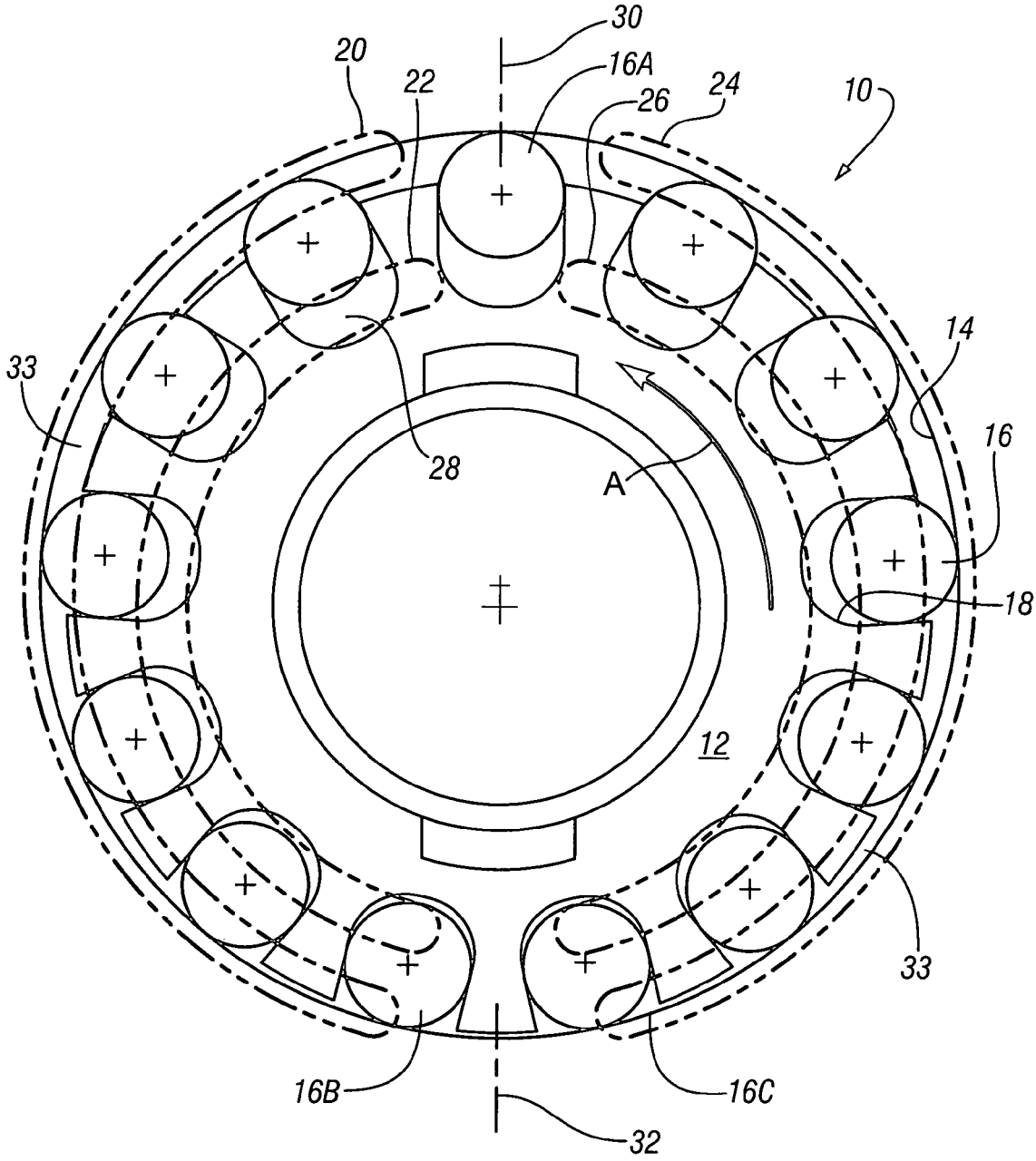
FIG. 1 is an elevational view of a roller pump incorporating the present invention.

As seen in FIG. 1, a hydraulic pump 10 has a rotor 12, a ring 14, and a plurality of rollers 16. Each of the rollers 16 is disposed in a respective slot 18 formed in the rotor 12. The pump 10 has conventional side plates, not shown, in which are formed kidney ports 20, 22, 24, and 26.

When the rotor 12 is rotated in the direction of Arrow A, the rollers 16 move with the rotor 12, such that the ring 14 will force the rollers 16 inwardly as they transverse the ports outlet 20 and 22 and permit the rollers 16 to move radially outward as they traverse the inlet ports 24 and 26. The rollers 16 and the slots 18 cooperate to form a plurality of spaces or volumes 28. As the rollers 16 move inwardly, the spaces 28 decreases in size such that fluid therein is discharged through the port 22. As the rotor 12 moves the rollers 16 from a top dead center 30 toward a bottom dead center 32, a space 33 between the rotor 12 and the ring 14 steadily decreases thereby forcing fluid in this space into the port 20. Also, as the rotor 12 rotates from the bottom dead center 32 to the top dead center 30, the spaces 28 increase thereby filling with fluid while and the space 33 also increases thereby filling that space with fluid. Thus, the rotation from bottom dead center 32 to top dead center 30 is known as the inlet stroke and from top dead center 30 to bottom dead center 32 is known discharge stroke.

Figure 2:
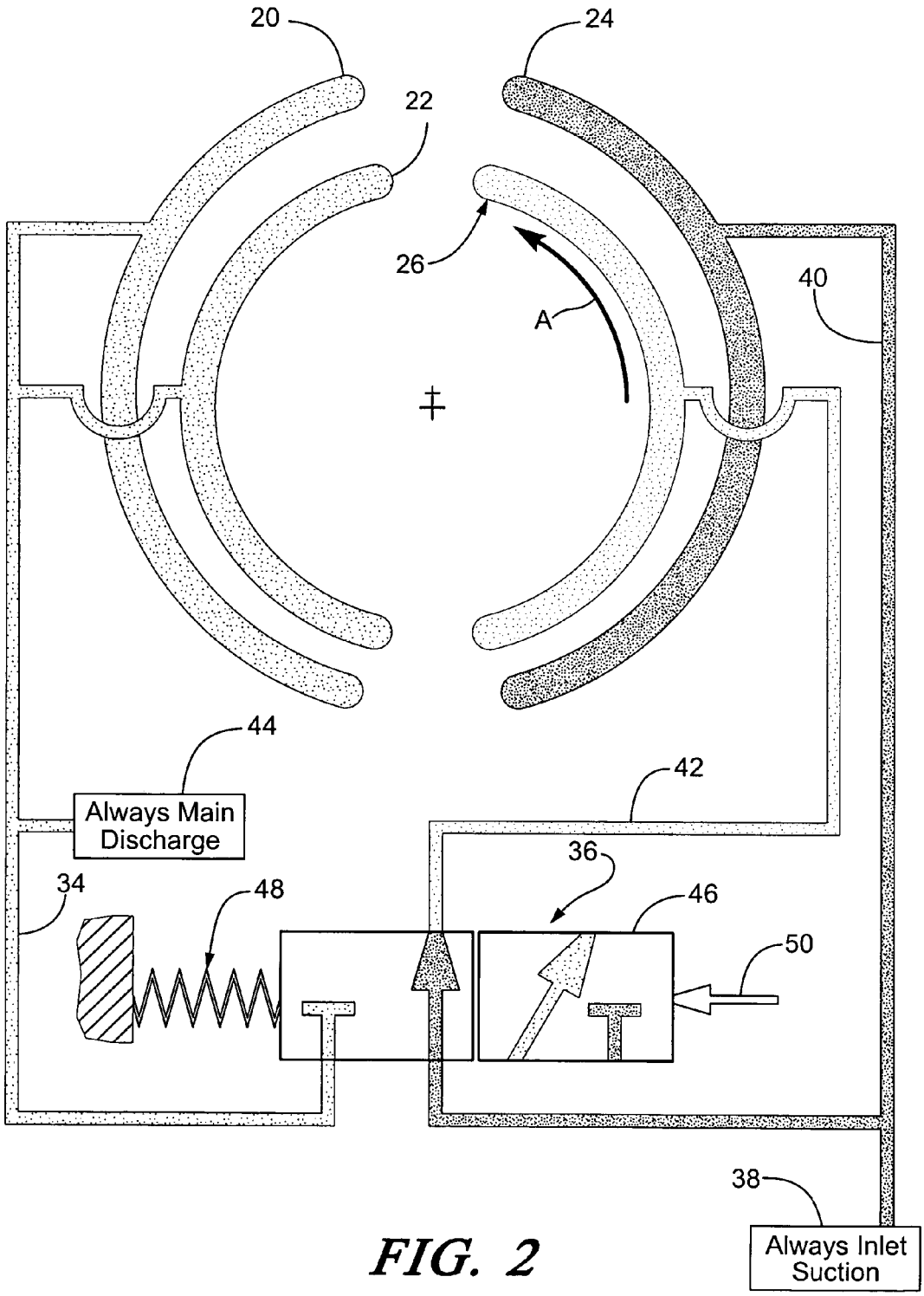
FIG. 2 is a diagrammatic representation of a portion of the roller pump and a control valve mechanism connected therewith.

As seen in FIG. 2, the ports 20 and 22 are connected with a passage 34, which in turn is connected with a control valve 36. The port 24 is connected with a reservoir 38 and through a passage 40, which is also connected with the valve 36. The valve 36 is connected with the port 26 through a passage 42. The passage 34 is in continuous communication with a hydraulic system 44. The valve 36 includes a spool or slide mechanism 46, which is urged rightward, as seen in FIG. 2, by a bias spring 48 and may be urged leftward against the bias spring 48 by a pressure control signal represented by the arrow 50.

In the spring set position shown, the valve 36 connects the reservoir 38 with the passage 42 and therefore the port 26. During the spring set position, the passage 34 is blocked at the valve 36. When the valve 36 is placed in the pressure set position with a control pressure at arrow 50, the valve member 46 moves against the spring 48 to provide communication between the passage 34 and the passage 42 while simultaneously disconnecting communication between the passage 40 and passage 42.

When this occurs, some of the fluid (approximately the amount discharged from the spaces 28) in the passage 34 will be directed through the valve 36 to the passage 42 and thence through the port 26, which is present at the underside or radially inward side of the rollers 16. This portion of the high-pressure fluid will operate to pressurize the radially inward portion of the rollers 16 such that it is not delivered to the hydraulic system 44 but is rather recycled through the pump 10 thereby reducing the high pressure output fluid volume of the pump 10, which is delivered to the hydraulic system 44. Thus, a two-stage pump is created.

By way of example, the two-stage pump may be designed with the following characteristics in mind. The total pump displacement being 49.26 cubic centimeters per revolution; the low flow pump displacement, that is, the inner port 22, being 21.18 cubic centimeters per revolution, thus the ratio of low flow volume to total flow volume is 43 percent. The hydraulic pump 10 includes thirteen rollers having a roller diameter of 18 millimeters and a roller length of 20 millimeters. The area between the radially outer portion of the rotor 12 and the ring 14 is 61.57 square millimeters, and the area of the inner portion between the rollers 16 and the bottom of slots 18 is 20.84 square centimeters. These numbers are given by way of example only and are not designed or considered to be limiting of the invention.

The pump 10 is also designed so that the crossover of both the inner and outer portions at top and bottom dead centers occur at the top of the sine wave, which is conventional. The output flow of a gerotor pump and/or roller type pump is generally a sine wave function. By having the crossover occur at the top of the sine wave, the lowest output flow or change in flow per degree of revolution is encountered. This will aid in quieting the pump. Also, during the crossover of the rollers occur at one-half intervals; that is, when a roller is crossing at top dead center 30 there is no crossover at bottom dead center 32 and vice versa.

As seen in FIG. 1, the roller 16A is between the ports 20, 22, 24, 26, while the roller 16B is connected with ports 20, 22 and the roller 16C is connected with ports 24, 26. However, as the rotor rotates in the direction of arrow A, the roller 16B will be positioned between the ports and the roller 16A will have encountered the ports 20 and 22. This reduces the pressure fluctuations that occur during crossover and provide for a mechanism acting as if it had twenty-six rollers rather than thirteen.

The invention claimed is:

1. A two-stage hydraulic pump comprising:

a rotor having an axis of rotation and a plurality of slots each radially extending from a circumference of said rotor toward said axis of rotation;

a plurality of pumping members each slidably disposed in a different one of said plurality of slots to thereby define a pumping volume therebetween;

a ring member disposed radially outwardly of said rotor and contacting said pumping members during a rotation of said rotor to permit outward movement of each of said pumping members during an inlet stroke of the pump to increase said pumping volume and inward movement of each of said pumping members during a discharge stroke of the pump to decrease said pumping volume;

the pump having two discharge ports each at least partially coextensive with said rotor, one radially inward of said plurality of slots and the other radially outward adjacent said ring, said two discharge ports communicating with a discharge passage, and two inlet ports each at least partially coextensive with said rotor, one radially inward of said slots and the other radially outward adjacent said ring;

a valve for providing fluid communication between said discharge passage and one of said inlet ports while disconnecting said inlet ports during a low flow arrangement and interconnecting said inlet ports during a high flow arrangement;

wherein a 180 degree rotation of said rotor from a bottom dead center position to a top dead center position defines said inlet stroke, and a 180 degree rotation of said rotor from said top dead center position to said bottom dead center position defines said discharge stroke.

2. The two-stage hydraulic pump defined in claim 1, wherein said valve is operable for communicating a portion of an amount of fluid flowing from said two discharge ports to said one inlet port that is radially inward of said plurality of slots.

3. The two-stage hydraulic pump defined in claim 1, wherein said inlet port adjacent said ring is continuously connected with a reservoir.

4. The two-stage hydraulic pump defined in claim 1, wherein said plurality of pumping members is a plurality of cylindrical pumping rollers.

5. The two-stage hydraulic pump defined in claim 4, wherein said plurality of cylindrical pumping rollers each have a diameter of approximately 18 millimeters and a length of approximately 20 millimeters.

6. The two-stage hydraulic pump defined in claim 5, wherein an area between a radially outward portion of said cylindrical pumping rollers and said ring is approximately 60 millimeters, and an area between a radially inward portion of each said cylindrical pumping roller and a bottom portion of a slot in which said cylindrical pumping roller is disposed is approximately 20 square centimeters.

7. A hydraulic pump operable for producing a supply of pressurized fluid in a first and a second stage, the hydraulic pump comprising:

a rotor having an axis of rotation and a plurality of equally spaced U-shaped slots opening to a radially outermost surface of said rotor;

a plurality of rollers each having a circular cross-section, and each being disposed in a respective one of said U-shaped slots to form a pumping volume therebetween; wherein each of said pumping volumes has a diameter approximately equal to a diameter of said circular cross-section;

a ring circumscribing said rotor, said ring continuously contacting a radially outward portion of each of said plurality of rollers;

a pair of inlet ports and a pair of discharge ports, each of said inlet and said discharge ports being at least partially coextensive with a cross-sectional area of said rotor;

said pair of discharge ports communicating with a discharge passage;

a control valve having a moveable spool mechanism for selectively connecting said discharge passage with one of said pair of inlet ports for recycling a supply of pressurized fluid back to the pump while disconnecting said inlet ports during a low flow arrangement and interconnecting said inlet ports during a high flow arrangement;

wherein said ring is operable for forcing each of said plurality of rollers radially inward during a rotation of said rotor to thereby reduce said pumping volume during a discharge stroke of the pump, and for permitting outward movement of each of said rollers during an inlet stroke of the pump to increase said pumping volume.

8. The hydraulic pump of claim 7, wherein a 180 degree rotation of said rotor from a bottom dead center position to a top center dead position defines said inlet stroke, and a 180 degree rotation of said rotor from said top dead center position to said bottom dead center position defines said discharge stroke.

* * * * *